US006209986B1

(12) United States Patent
Tatsuzawa

(10) Patent No.: US 6,209,986 B1
(45) Date of Patent: Apr. 3, 2001

(54) INKJET PRINTERS

(75) Inventor: Hajime Tatsuzawa, Tokyo (JP)

(73) Assignee: Mutoh Industries Ltd., Tokyo (JP)

( * ) Notice: Subject to any disclaimer, the term of this patent is extended or adjusted under 35 U.S.C. 154(b) by 0 days.

(21) Appl. No.: 09/401,958

(22) Filed: Sep. 23, 1999

(30) Foreign Application Priority Data

Nov. 18, 1998 (JP) ..... 10-328519

(51) Int. Cl.[7] ..... B41J 2/145; B41J 2/15; B41J 29/38

(52) U.S. Cl. ..... 347/40; 347/16

(58) Field of Search ..... 347/40, 16, 104

(56) References Cited

U.S. PATENT DOCUMENTS 5,689,294 * 11/1997 Karz et al. ..... 347/40
5,940,093 * 8/1999 Bolash et al. ..... 347/16
6,068,366 * 5/2000 Bolash et al. ..... 347/43

* cited by examiner

*Primary Examiner*—Thinh Nguyen
(74) *Attorney, Agent, or Firm*—Sughrue, Mion, Zinn, Macpeak & Seas, PLLC

(57) ABSTRACT

The invention is directed to a method of printing on a print medium wherein an image output region is segmented into a plurality of bands and an image, corresponding to one of these bands, is printed on the print medium. If the image is printed on the last or final band, then a moving value is calculated. The moving value is calculated by subtracting a number of nozzles of an inkjet head that have discharged ink in printing the image from a total number of nozzles. The print medium is then moved, in a reverse direction, a distance that corresponds to the moving value.

4 Claims, 4 Drawing Sheets

S1
plotting data analysis
S2
1 band portion plottng
S3
final band ?
YES
NO
S4
forward feed by one band portion
X= total number of nozzler -number of actually discharged nozzles
S5
L=distance correponding to X+corrected value such as backlash
S6
S7
inverse feed of amount corresponding to L
S8
completion of one sheet plotting

INKJET PRINTERS

BACKGROUND OF THE INVENTION

The present invention relates to an inkjet printer for outputting plotting data prepared in a host computer to paper.

Inkjet printers have been known in the art wherein an image output region corresponding to one page of the paper is divided into a plurality of bands, and the image information to be outputted is written to a bit map memory in raster data form for each band, and the image data in the bit map memory is used to control the ink discharge from nozzles of the inkjet head to output the image on long sized paper for each band.

In the preparation of the image, there is a limit to the length that the inkjet printer can plot in one operation because of a limitation coordinates to be handled in the application at the host computer side. For example, if the axis has coordinates up to 32767, in a printer with a resolution of 360 dpi, 32767×(25.4/360)=2311 mm is the longest length that can be handled.

Under these circumstances, a method may be used wherein the data is sectioned into certain block lengths and plotted with upper portion margin and a lower portion margin of zero, so that the next plotting is continuous with the present plotting, which effectively permits longer plotting.

In this case, as shown in FIG. 4(A), the sectioned data is regarded as data coupled with the number of nozzles of an inkjet head 14. A final image 30 of the first page (1st sheet) coincides with a discharge nozzle region D of the inkjet head 14. Accordingly, in this condition, if the paper is carried in the forward direction by a portion of width of the inkjet head 14, the band image of the second page (2nd sheet) can be made continuous with the final band image 30 of the first page with the zero margin.

However, as shown in FIG. 4(B), in case the sectioned data is not coincident with the number of nozzles of the inkjet head 14, the undischarge nozzle region X of the inkjet head 14 is not coincided with the final band image 30 on the first page. For this reason, when the plotting of the second page is to be made, where the paper is carried in the forward direction by the head width portion of the inkjet head 14, a white stripe of the undischarged nozzle region X portion is formed between the final image 30 on the first page and the first band image on the second page, which causes the discontinuation of the next plotting.

Normally, when plotting image is to be prepared at the host computer side, an operator is not required to be conscious of the number of nozzles of the plotting head of the printer. Furthermore, the application at the host computer side corresponds to a variety of printers in many cases, and since there is a possibility that the number of nozzles of the inkjet is variable among the printers, there is a problem in that the preparation of data matched with the printers is difficult.

The present invention has an object of solving the foregoing problems.

SUMMARY OF THE INVENTION

The present invention is constructed in such a way that a certain data segmented to a certain block length is subjected to a band plotting with an upper portion margin and a lower portion margin of zero, and the resulting band plotting is made to be continuous with the next plotting, and as a result, in case of performing a longer plotting, it can prevent the generation of a white stripe at the splice between the final band image of the previous plotting and the band image of the next plotting.

The inkjet printer segments an image output region of one page portion into a plurality of bands, and stores an image to be outputted in a bit map memory in the mode of a raster data for each band, and the image stored in the bit map memory is outputted to each band by discharging the ink from the nozzles of the inkjet head onto the long size paper. A CPU determines the number of the nozzles counting from the first nozzle that discharges the ink out of the total number of the nozzles of the inkjet head, and feeds inversely the plotting paper by only a distance portion corresponding to the number of the undischarged nozzles, or an amount corresponding to the backlash portion of the number of the undischarged nozzles and the paper carrying mechanism.

DESCRIPTION OF THE DRAWINGS

FIG. 4A represents sectioned data of an entire image that is coincident with the number of nozzles of an inkjet head.

FIG. 4B represents sectioned data that is not coincident with the number of nozzles of an inkjet head.

DETAILED DESCRIPTION OF THE INVENTION

The mode of an embodiment of the present invention will be described in details by referring to the attached figures.

Figure 2:
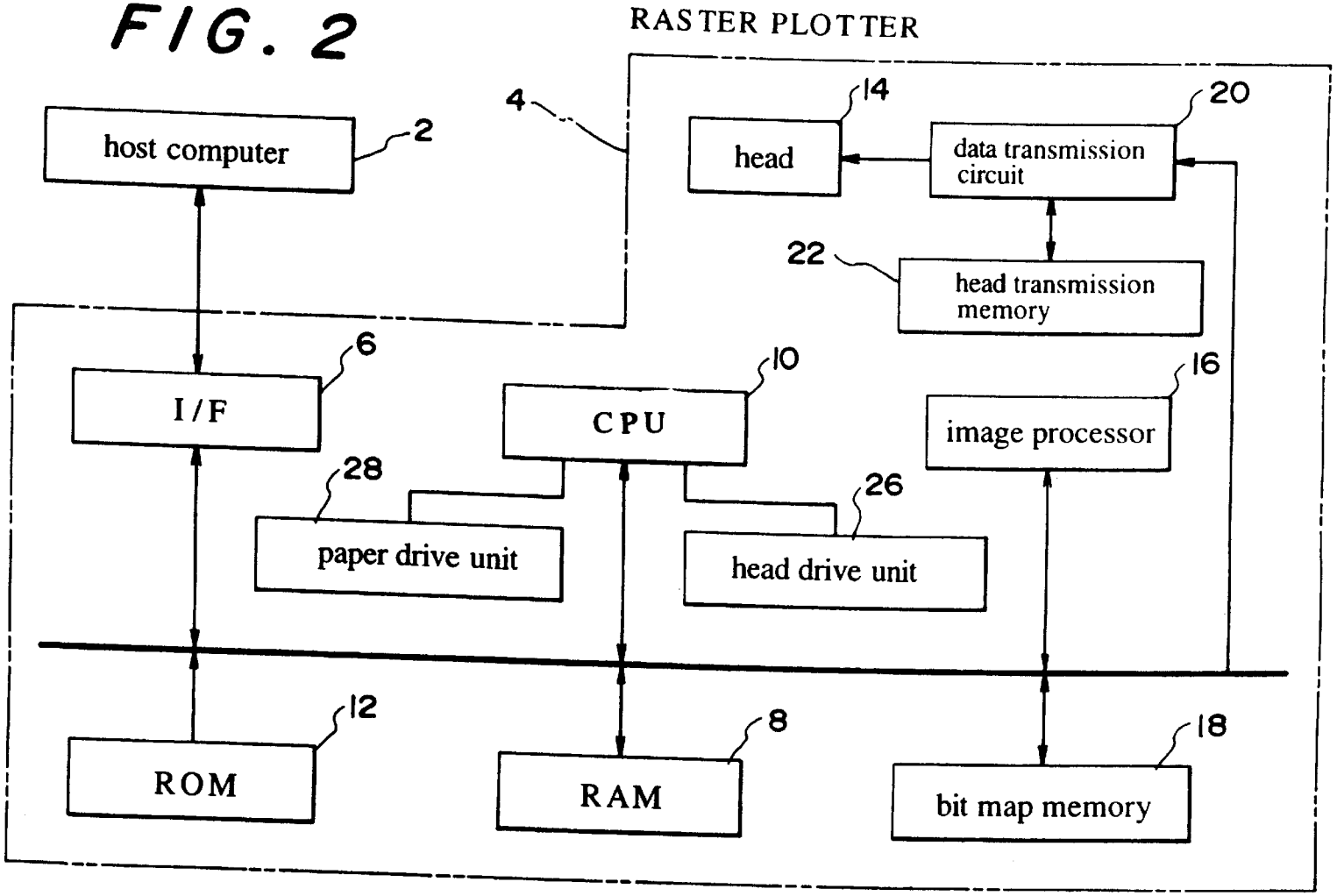
FIG. 2 is a block diagram of an inkjet printer.

FIG. 2 is a block diagram showing a construction of an inkjet printer 4 to which a plotting method according to an embodiment of the present invention is applied. An interface 6 of the inkjet printer 4 is connected to a host computer 2 that outputs an image information such as a design drawing that is prepared using an input device not shown herein. This image is usually represented by vector data.

The inkjet printer 4 is constructed in such a way that printing and outputting are carried out by converting the vector data transmitted from the host computer 2 to raster data. The vector data transmitted from the host computer 2 is stored into a RAM 8 by means of the interface 6 provided with a FIFO buffering function. The CPU 10 analyses the data against the plotted vector data stored in the RAM 8 on the basis of a program stored in a ROM 12, and segments the vector data contained in each band into a system (for example, vector) of an intermediate code by applying processing such as a segmentation processing with a preset band width, and sort processing and the like.

Figure 3:
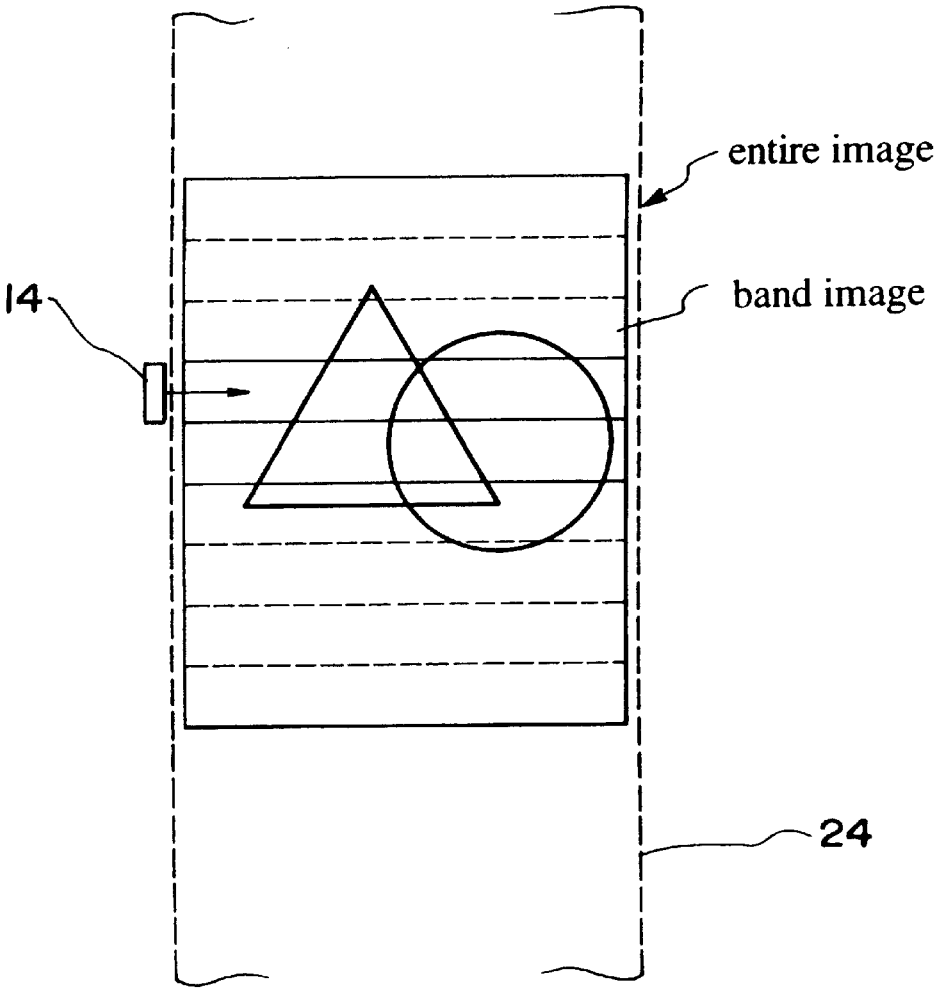
FIG. 3 is an explanation drawing showing an entire image to be outputted by the inkjet printer.

An image processor 16 applies a DDA processing sequentially to the image of the intermediate code system that is stored in the RAM 8, and converts the image represented by intermetiate code into raster data which is stored in a bit map memory 18. The raster data that is stored in the bit map memory 18 is sequentially fed to an inkjet head 14 through a data transmission circuit 20, and the raster data is copied by a head transmission memory 22. The inkjet head 14, as shown in FIG. 3, is driven by a head drive unit 26 in a horizontal direction that crosses the vertical direction, and transfers reciprocatingly in the horizontal direction (X axis direction) against a paper 24. On the other hand, the paper 24 is driven in a vertical direction (Y axis direction) by a paper drive unit 28, and the image represented by the raster data is printed on a band on the paper 24 by the inkjet head 14.

Figure 1:
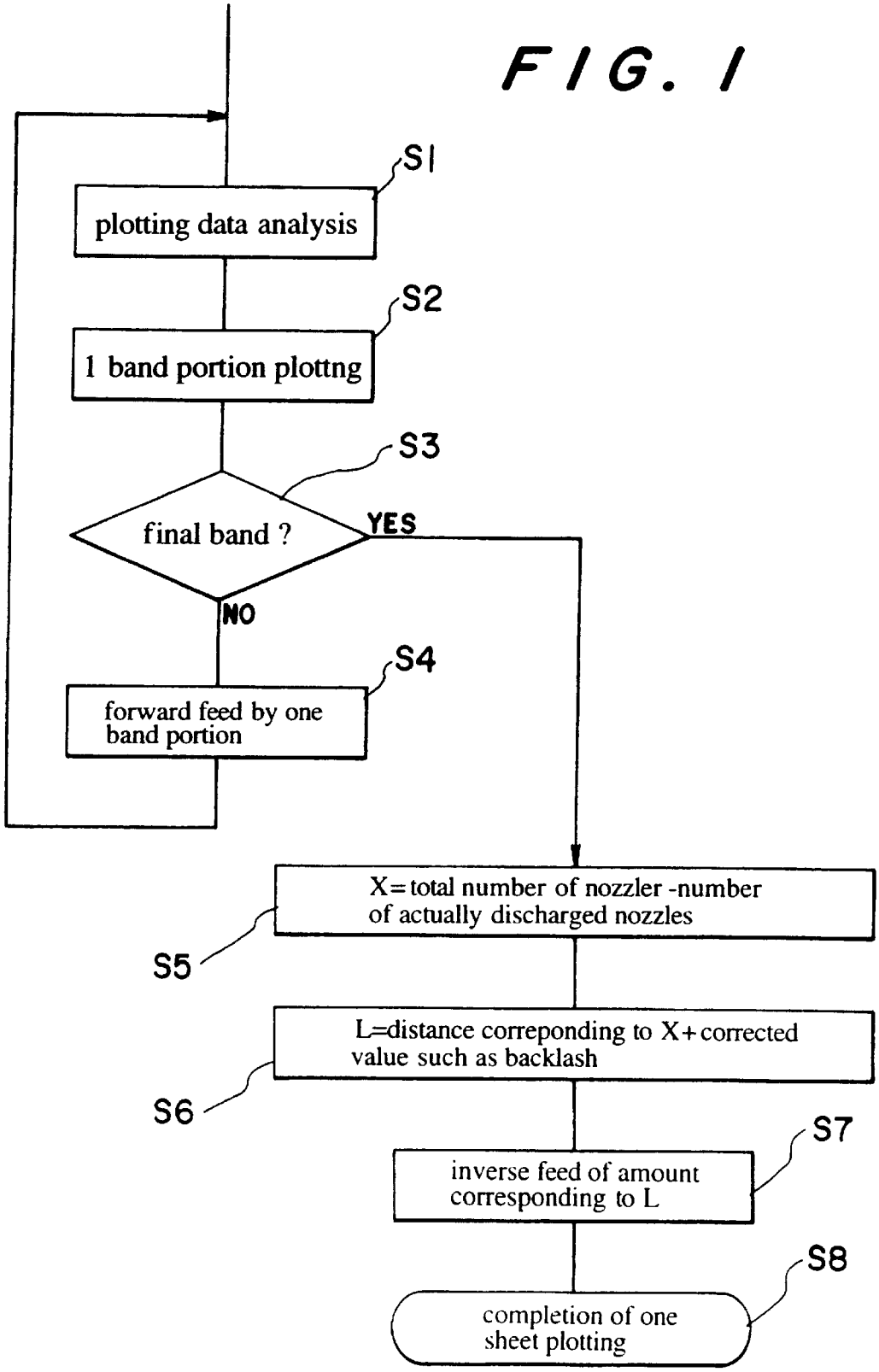
FIG. 1 is a flow chart showing an operation of the present invention.

Next, an operation of the inkjet printer in long size plotting will be explained by referring to FIG. 1.

Figure 4:
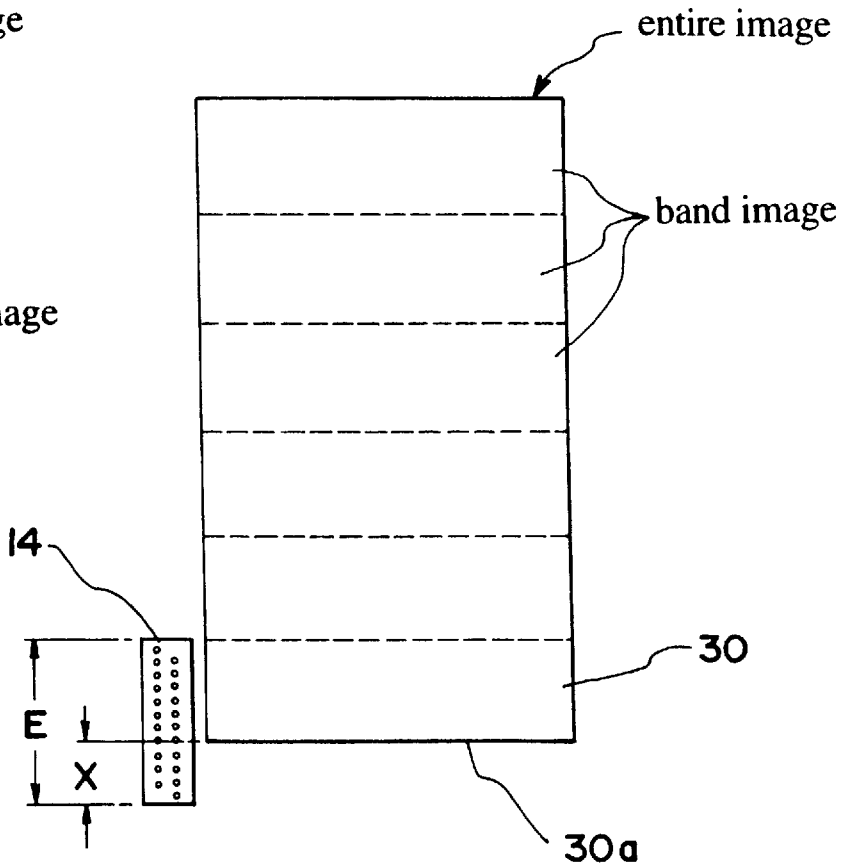
FIG. 4 is an explanation drawing of conventional arts.
Figure 4:
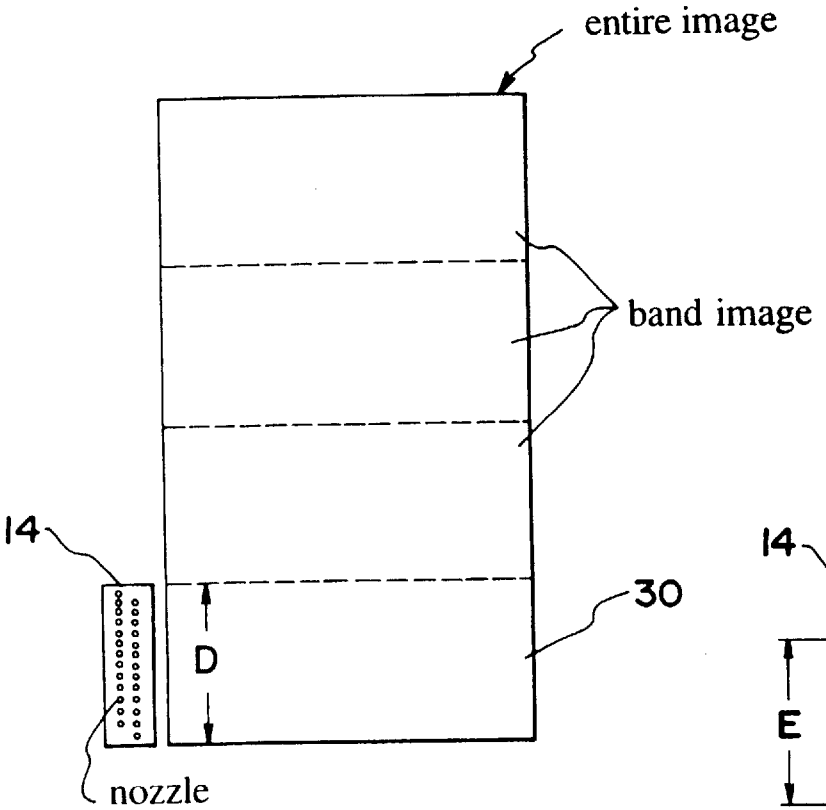

The CPU 10 performs an analysis of the plotting data (step 1) that is stored in the RAM 8 on the basis of the program stored in the ROM 12, and performs the plotting of one band portion (step 2). At this time, if the number of nozzles of the inkjet printer 14 is coincident with the number of data, as shown in FIG. 4(A), a nozzle disposition region D of the inkjet head 14 is coincident with the band width of the band image 30 to be printed on the paper. However, if the number of nozzles of the inkjet head 14 is not coincident with the number of data, namely, in case less than all of the nozzles of the inkjet head 14 are used in the plotting of one band, as shown in FIG. 4(B), the nozzle disposition region D of the inkjet head 14 is not coincident with the band width of the band image 30.

Next, the CPU 10 determines whether or not the plotted band image is the final band (step 3). If it is not the final band, the paper 24 that corresponds to one band portion is carried in the forward direction, and the process returns to step 1, and continues band plotting. When it is the final band, the CPU 10 computes (step 5) a value X by subtracting the number of the nozzles that actually discharge the ink from the total number of nozzles of the inkjet head 14. This value X corresponds to the distance of the disposition region of the nozzles in the X axis direction which are not used in the band image of the inkjet head 14.

The CPU 10 computes (step 6) a value L by adding a corrected value such as the backlash of the paper carrying mechanism to the distance corresponding to the value X. Then, the CPU 10 drives the paper drive unit 28 and carries the paper 24 by the amount corresponding to the value L in the reverse direction (step 7), and completes the plotting of one page portion. The end of the nozzle is cause to be below a base 30*a* of the final band image 30 by the inverse feeding of the paper in an amount corresponding to the value L of the paper 24.

Accordingly, when the plotting of the second page starts, even if the paper 24 is carried in the X axis direction and in the forward direction by the head width, namely, the nozzle disposition region E, the starting end of the nozzle disposition region E of the inkjet head 14 adjoins the base 30*a* of the final band image 30 of the preceding page with a zero gap, and can plot the band image of the next frame (page) continuously without causing a gap with the band image 30 of the preceding frame.

The present invention has been constructed as described in the foregoing, and even if the plotting data is received from a general (application), long size plotting without the white stripe becomes feasible.

What is claimed is:

1. A method of printing on a print medium comprising the steps of:

segmenting an image output region into a plurality of bands;

printing an image corresponding to one of said plurality of bands;

determining if said one band is the final band of said image output region, and, if said one band is the final band, calculating a moving value, said moving value being calculated by subtracting a number of nozzles of an inkjet head that have discharged ink in printing said one band image from a total number of nozzles of an inkjet head; and advancing in a reverse direction said print medium by a distance that corresponds to said moving value.

2. A method of printing on a print medium comprising the steps of:

segmenting an image output region into a plurality of bands;

printing an image corresponding to one of said plurality of bands;

determining if said one band is the final band of said image output region, and, if said one band is the final band, calculating a moving value, said moving value being calculated by subtracting a number of nozzles of an inkjet head that have discharged ink in printing said one band image from a total number of nozzles of an inkjet head and adding a corrected value; and advancing in a reverse direction said print medium by a distance that corresponds to said moving value.

3. A method of printing on a print medium according to claim 2, wherein said corrected value is determined by computing a backlash of a paper carrying mechanism.

4. A method of printing on a print medium comprising the steps of:

segmenting an image output region of one page portion into a plurality of bands by analyzing an image represented by vector data;

converting said image represented by vector data into an image represented by raster data;

writing said image represented by raster data in a bit map memory;

printing said image represented by raster data corresponding to one of said plurality of bands;

determining if said one band is the final band of said image output region, and, if said one band is the final band, calculating a moving value, said moving value being calculated by subtracting a number of nozzles of an inkjet head that have discharged ink in printing said one band image from a total number of nozzles of an inkjet head; and advancing in a reverse direction said print medium by a distance that corresponds to said moving value.

* * * * *